US009386644B2

(12) United States Patent
Moon et al.

(10) Patent No.: US 9,386,644 B2
(45) Date of Patent: Jul. 5, 2016

(54) AC DIRECT DRIVE LIGHTING SYSTEM FOR PROVIDING UNIFORM LIGHT DISTRIBUTION

(71) Applicant: Altoran Chips & Systems, Santa Clara, CA (US)

(72) Inventors: Kyeongtae Moon, San Ramon, CA (US); Jae Hong Jeong, Saratoga, CA (US); Minjong Kim, San Jose, CA (US); Weifeng Chen, San Jose, CA (US); Juhwan Jeong, Suwon (KR)

( * ) Notice: Subject to any disclaimer, the term of this patent is extended or adjusted under 35 U.S.C. 154(b) by 0 days.

(21) Appl. No.: 14/547,556

(22) Filed: Nov. 19, 2014

(65) Prior Publication Data

US 2015/0137696 A1 May 21, 2015

Related U.S. Application Data

(60) Provisional application No. 61/906,615, filed on Nov. 20, 2013.

(51) Int. Cl.
*H05B 33/08* (2006.01)

(52) U.S. Cl.
CPC ..... *H05B 33/0824* (2013.01)

(58) Field of Classification Search
CPC ..... H05B 33/0815; H05B 33/0818; H05B 37/02; H05B 41/3925; H05B 41/391; H05B 41/2828; H05B 33/0803
USPC ..... 315/294, 224, 291, 323, 185, 194, 307
See application file for complete search history.

(56) References Cited

U.S. PATENT DOCUMENTS 7,081,722 B1 * 7/2006 Huynh ..... H05B 33/0818 315/185 S
2005/0253533 A1 * 11/2005 Lys ..... H05B 33/0815 315/224
2010/0213859 A1 * 8/2010 Shteynberg ..... H05B 33/0815 315/224
2011/0273102 A1 * 11/2011 van de Ven et al. H05B 33/0809 315/193
2011/0309759 A1 * 12/2011 Shteynberg ..... H05B 33/0815 315/201
2012/0206064 A1 * 8/2012 Archenhold ..... H05B 33/0812 315/297
2012/0223650 A1 * 9/2012 Radermacher ..... H05B 37/0254 315/200 R
2014/0265898 A1 * 9/2014 Del Carmen, Jr. . H05B 33/0815 315/200 R
2015/0028769 A1 * 1/2015 Lai ..... H05B 33/0887 315/294
2015/0035443 A1 * 2/2015 Hill ..... H05B 33/0857 315/192
2015/0115809 A1 * 4/2015 Siessegger ..... H05B 33/0803 315/185 R
2015/0115830 A1 * 4/2015 Siessegger ..... H05B 33/0803 315/291

FOREIGN PATENT DOCUMENTS

WO WO 2013090945 A1 * 6/2013 ..... H05B 33/0815

* cited by examiner

*Primary Examiner* — Douglas W Owens
*Assistant Examiner* — Syed M Kaiser
(74) *Attorney, Agent, or Firm* — Patent Office of Dr. Chung Park

(57) ABSTRACT

An AC lighting system for providing uniform light distribution is disclosed. According to one embodiment, the AC lighting system includes an AC driver and LED packages electrically connected to the AC driver. Each LED package includes a plurality of LED elements and is physically distributed over an illuminating surface of the AC lighting system. The AC driver has a first current sink that drives a first LED group and a second current sink that drives the first LED group and a second LED group. The first LED group includes at least one LED element from each of the LED packages, and the second LED group includes at least one LED element other that the first set of LED elements from each of the LED packages.

21 Claims, 8 Drawing Sheets

AC DIRECT DRIVE LIGHTING SYSTEM FOR PROVIDING UNIFORM LIGHT DISTRIBUTION

CROSS REFERENCES

This application claims the benefits of and priority to U.S. Provisional Application No. 61/906,615, filed on Nov. 20, 2013, entitled "AC Direct Step Driver Lighting System for Equal Light Distribution," the disclosure of which is hereby incorporated by reference in its entirety.

FIELD

The present disclosure relates in general to the field of AC lighting systems, and in particular, to an AC direct step driver lighting system for providing uniform light distribution.

BACKGROUND

An alternating current (AC) lighting system refers to a system that directly drives a lighting load such as light emitting diode (LED), organic light emitting diode (OLED), or other light emitting devices or components using rectified AC line voltage from an AC power source. AC lighting systems eliminate the need of a power conversion unit from an AC power source to a direct current (DC) power source. Due to their simple design and less components, AC lighting systems provide a low-cost solution for residential or commercial applications receiving power directly from an AC power source.

Despite their cost advantages, implementation of advanced features such as dimming control, mood lights, and color variations in a conventional AC lighting system poses technical difficulties because the fluctuating AC line voltage. Furthermore, LED segments in a conventional AC lighting system are often driven in a sequential order, therefore light emitted from each LED segment is not uniform across a light fixture.

SUMMARY

An AC lighting system for providing uniform light distribution is disclosed. According to one embodiment, the AC lighting system includes an AC driver and LED packages electrically connected to the AC driver. Each LED package includes a plurality of LED elements and is physically distributed over an illuminating surface of the AC lighting system. The AC driver has a first current sink that drives a first LED group and a second current sink that drives the first LED group and a second LED group. The first LED group includes at least one LED element from each of the LED packages, and the second LED group includes at least one LED element other that the first set of LED elements from each of the LED packages.

According to another embodiment, an AC lighting driver includes a voltage input for receiving AC power from an AC power source, and a plurality of current sinks. The first current sink is connected to and drives a first LED group, and the second current sink is connected to and drives a second LED group. The first LED group includes at least one LED element from each of the plurality of LED packages, and the second LED group includes at least one LED element other that the first set of LED elements from each of the plurality of LED packages.

The above and other preferred features, including various novel details of implementation and combination of events, will now be more particularly described with reference to the accompanying figures and pointed out in the claims. It will be understood that the particular systems and methods described herein are shown by way of illustration only and not as limitations. As will be understood by those skilled in the art, the principles and features described herein may be employed in various and numerous embodiments without departing from the scope of the present disclosure.

BRIEF DESCRIPTION OF THE DRAWINGS

The accompanying drawings, which are included as part of the present specification, illustrate the presently preferred embodiment and together with the general description given above and the detailed description of the preferred embodiment given below serve to explain and teach the principles described herein.

Figure 1:
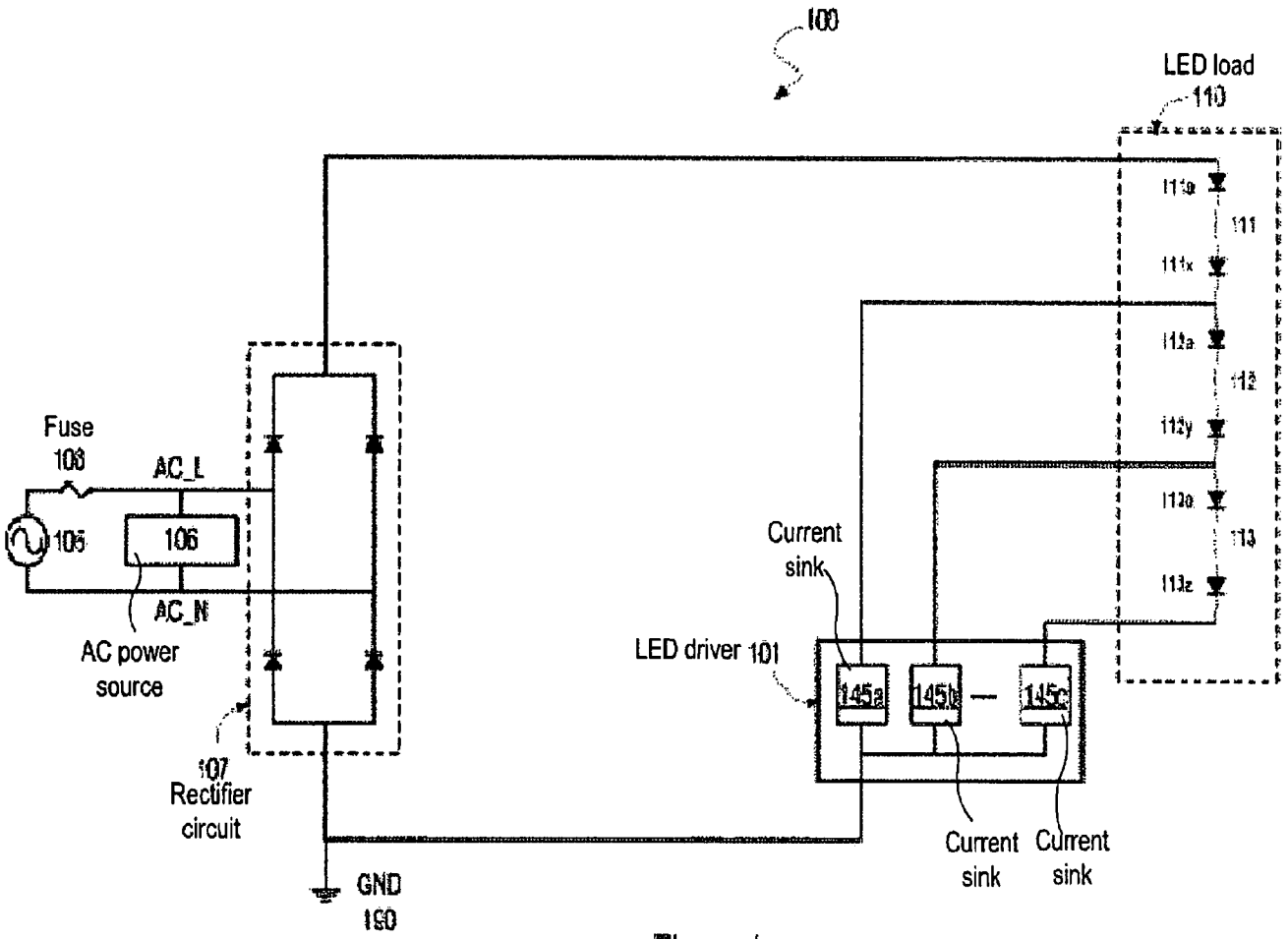
FIG. 1 illustrates a block diagram of an exemplary direct drive AC lighting system, according to one embodiment.

The figures are not necessarily drawn to scale and elements of similar structures or functions are generally represented by like reference numerals for illustrative purposes throughout the figures. The figures are only intended to facilitate the description of the various embodiments described herein. The figures do not describe every aspect of the teachings disclosed herein and do not limit the scope of the claims.

DETAILED DESCRIPTION

An AC lighting system for providing uniform light distribution is disclosed. Each of the features and teachings disclosed herein can be utilized separately or in conjunction with other features and teachings to provide a method for providing an AC light system with a control unit for controlling power of an LED. Representative examples utilizing many of these additional features and teachings, both separately and in combination, are described in further detail with reference to the attached drawings. This detailed description is merely intended to teach a person of skill in the art further details for practicing preferred aspects of the present teachings and is not intended to limit the scope of the claims. Therefore, combinations of features disclosed in the following detailed description may not be necessary to practice the teachings in the broadest sense, and are instead taught merely to describe particularly representative examples of the present teachings.

In the following description, for purposes of explanation only, specific nomenclature is set forth to provide a thorough understanding of the present invention. However, it will be apparent to one skilled in the art that these specific details are not required to practice the present invention.

Some portions of the detailed descriptions that follow are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

Moreover, the various features of the representative examples and the dependent claims may be combined in ways that are not specifically and explicitly enumerated in order to provide additional useful embodiments of the present teachings. It is also expressly noted that all value ranges or indications of groups of entities disclose every possible intermediate value or intermediate entity for the purpose of original disclosure, as well as for the purpose of restricting the claimed subject matter. It is also expressly noted that the dimensions and the shapes of the components shown in the figures are designed to help to understand how the present teachings are practiced, but not intended to limit the dimensions and the shapes shown in the examples.

The present disclosure relates to a system and method for providing uniform light distribution using an AC direct step driver. The AC lighting system refers to a system driving a lighting load such as LED, OLED, and other light emitting devices using rectified AC line voltage directly. The AC lighting system thus eliminates the needs of power conversion from AC to DC. According to various embodiments, the present system and method establishes uniform lighting distribution in AC direct step lighting system.

An AC lighting system for providing uniform light distribution is disclosed. According to one embodiment, the AC lighting system includes an AC driver and LED packages electrically connected to the AC driver. Each LED package includes a plurality of LED elements and is physically distributed over an illuminating surface of the AC lighting system. The AC driver has a first current sink that drives a first LED group and a second current sink that drives the first LED group and a second LED group. The first LED group includes at least one LED element from each of the LED packages, and the second LED group includes at least one LED element other that the first set of LED elements from each of the LED packages.

FIG. 1 illustrates a block diagram of an exemplary direct drive AC lighting system, according to one embodiment. The AC lighting system 100 includes an LED driver 101 and an LED load 110. The LED driver 100 is powered by a power source 105 such as an alternative current (AC) power source including a fuse 108 and a transient protection circuit 106 between a live wire (AC_L) and a neutral wire (AC_N). The electrical current from the AC power source 105 is rectified by a rectifier circuit 107. The rectifier circuit 107 can be any suitable rectifier circuit, such as a bridge diode rectifier, capable of rectifying the alternating power from the AC power source 105. The rectified voltage $V_{rect}$ is applied to the LED load 110. If desirable, the AC power source 105 and the rectifier circuit 107 may be replaced by a direct current (DC) power source.

LED as used herein are a general term for many different kinds of LEDs, such as traditional LED, super-bright LED, high brightness LED, organic LED, etc. The LED driver 101 is configured to drive many different kinds of LEDs. The LED load 110 is electrically connected to the power source 105 and is in the form of a string of LEDs divided into three LED groups, 111-113. However, it should be apparent to those of ordinary skill in the art that the LED load 110 may contain any number of LED groups and LED elements (or LED dies) in each LED group, and may be divided into any suitable number of groups without deviating from the scope of the present subject matter. The LED elements in each LED group may be a combination of the same or different kind, such as different color. The LED load 110 can be connected in serial, parallel, or a mixture of both. In addition, one or more resistances may be included inside each LED group.

The LED driver 101 controls the LED current that flows through the LED load 110. According to one embodiment, the LED driver 101 is a direct AC step driver ACS0804 or ACS0904 by Altoran Chips and Systems of Santa Clara, Calif. The LED driver 101 integrates a plurality of high voltage current sinks 145*a*, 145*b*, and 145*c*. When the rectified voltage, $V_{rect}$, reaches a reference voltage $V_f$, the LED groups 111, 112, and 113 turn on gradually when the corresponding current sink 145 has a headroom. Each LED channel current sink increases up to a predefined current level for each current sink 145 and maintains its level until the following group's current sink reaches to its headroom. At any point in a time domain, there is at least one active LED group. When the active LED group is changed from one group to the adjacent group with a change in the rectified voltage, $V_{rect}$, new active group's current gradually increases while the existing active group's current gradually decreases. The mutual compensation between LED groups 111, 112, and 113 achieves a smooth LED current change preventing blinking or flickering.

Figure 2:
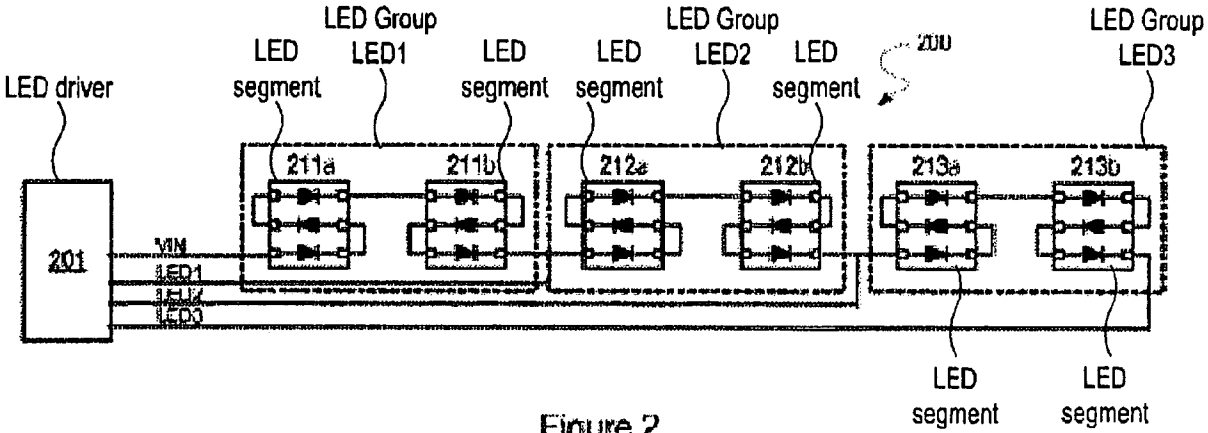
FIG. 2 illustrates an exemplary direct device AC lighting system, according to one embodiment.

FIG. 2 illustrates an exemplary direct device AC lighting system, according to one embodiment. The direct drive AC lighting system 200 includes an LED driver 201 and an LED load that includes LED segments 211*a*, 211*b*, 212*a*, 212*b*, 213*a*, and 213*b*. The LED driver 201 controls the LED current that flows through the LED load. According to one embodiment, the LED driver 201 integrates a plurality of high voltage current sinks for each LED groups, LED1, LED2, and LED3. When the rectified AC line voltage, VIN, is higher than an internal reference level, each LED group turns on when the corresponding current sink has a headroom. Each LED channel current sink increases up to a predefined current level for each current sink and maintains its level until the following channel's current sink reaches to its headroom. In this embodiment, each LED group has two LED segments. For example, LED group LED1 has LED 211*a* and 211*b*. Similarly, LED groups LED2 and LED3 have LED 212*a* and 212*b*, and 213*a* and 213*b*, respectively. Each LED segment has one or more LED elements connected in series, for example, three LED elements in series as shown in FIGS. 2-8. However, it is apparent to one of ordinary skill in the art would recognize that any number of LED groups, LED segments, and/or LED elements are used in an LED group without deviating from the scope of the present disclosure.

The LED segments that are closely located on the PCB board are grouped together as an LED group and are connected in series. This configuration simplifies the layout of a PCB board on which the LED elements and wirings are implemented. This configuration also minimizes the cross wiring between the LED segments and groups as the neighboring LED segments and groups connected. However, the serial configuration of the LED groups and LED segments in an LED group may not achieve the best uniform light distribution. For example, LED groups 1, 2, and 3 are located along a line on a mounting surface and form a LED strip. The turning-on sequence may be LED groups 1, 2, and 3 and the turning-off sequence may be LED groups 3, 2, and 1. Although the turning on/off sequences may occur in a quick succession, it may momentarily illuminate one side of the LED strip while the other side is completely off or flicking.

Figure 3:
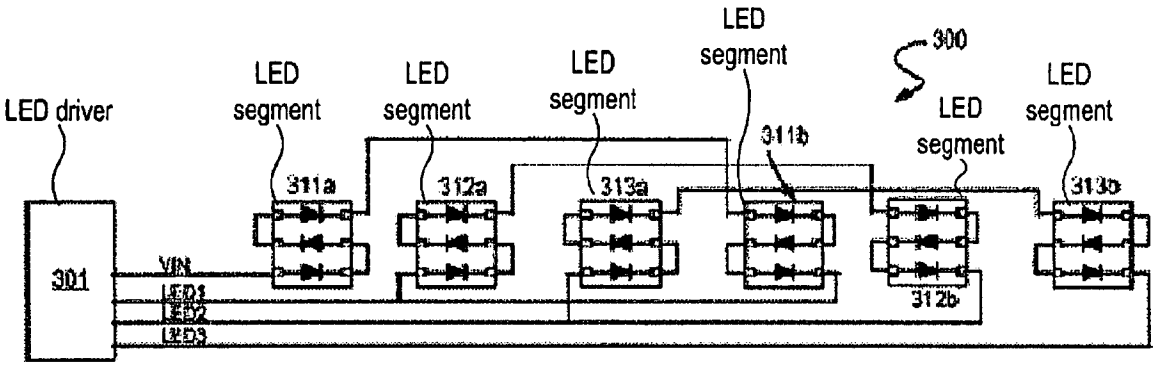
FIG. 3 illustrates an exemplary AC lighting system including a tube type LED light, according to one embodiment.

FIG. 3 illustrates an exemplary AC lighting system including a tube type LED light, according to one embodiment. The direct drive AC lighting system 300 includes an LED driver 301 and an LED tube or an LED string that includes LED segments 311*a*, 312*a*, 313*a*, 311*b*, 312*b*, and 313*b*. The LED driver 301 controls the LED current that flows through the LED tube. According to one embodiment, the LED driver 201 integrates a plurality of high voltage current sinks for each LED groups, LED1, LED2, and LED3.

In comparison with the AC lighting system 200 of FIG. 2, the direct drive AC lighting system 300 improves the light distribution by physically and geometrically distributing the LED groups 311, 312, and 313. The number of LED groups may vary depending on the size of the LED tube or the number of LED elements in the LED tube. The LED segments 311*a* and 311*b* that form the LED group 1 are serially connected but are distributed over the length of the LED tube to place the second LED segment 311*b* after the LED segment 313*a* of LED group 3 and the LED segment 312*b* of the LED group 2. Similarly, the LED segments 312*a* and 312*b*, and 313*a* and 313*b* are interspersed with other LED segments of other LED groups. The more LED segments and groups and the tighter the space between the LED segments, the more uniform the light emitting from the LED tube.

Figure 4:
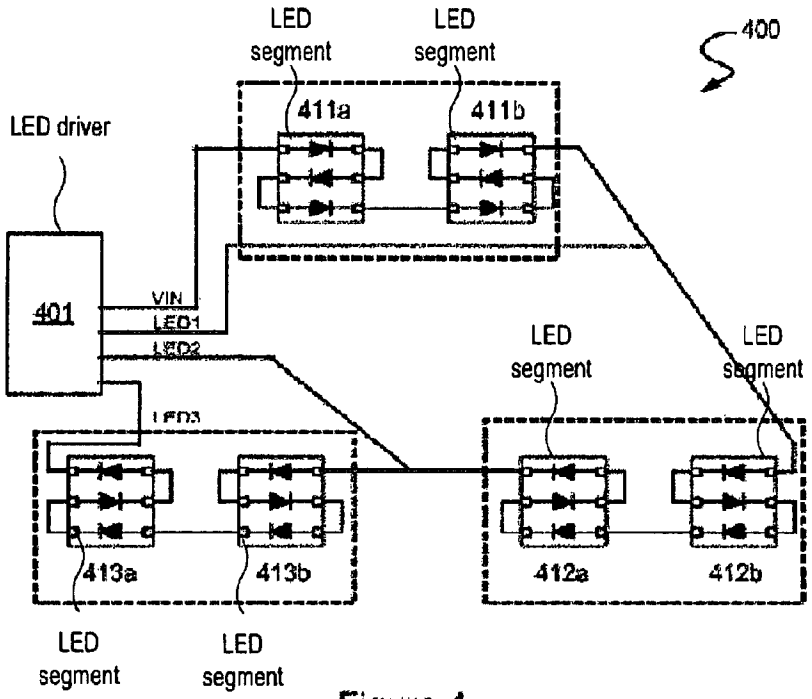
FIG. 4 illustrates an exemplary AC lighting system including a bulb type LED light, according to one embodiment.

FIG. 4 illustrates an exemplary AC lighting system including a bulb type LED light, according to one embodiment. The direct drive AC lighting system 400 includes an LED driver 401 and an LED bulb or that includes LED segments 411*a*, 412*a*, 413*a*, 411*b*, 412*b*, and 413*b*. The LED driver 401 controls the LED current that flows through the LED bulb. According to one embodiment, the LED driver 401 integrates a plurality of high voltage current sinks for each LED groups, LED1, LED2, and LED3. The direct drive AC lighting system 400 has physically and geometrically distributed the LED groups 411, 412, and 413. However, the LED elements in the LED groups 411, 412, and 413 are serially connected, therefore the LED groups 411, 412, and 413 turn on and off gradually in a sequence resulting in non-uniform light distribution. Each LED group has serially connected LED segments similar to the direct drive AC lighting system 200 of FIG. 2. For example, the LED segment 411*a* and 411*b* are placed next to each other. Similarly, LED segments 412*a* and 412*b*, and 413*a* and 413*b* are positioned closely to each other in a fashion to minimize the length of a connecting wire between the LED segments and largely between the LED groups. Different current flows for each LED group, therefore the LED groups turn on and off at different times based on the rectified input voltage to the LED driver 401. Each LED group covers only a portion of the illuminating surface of the AC lighting system 400. Resultantly, the direct drive AC lighting system 400 may have inequality in light distribution.

Figure 5:
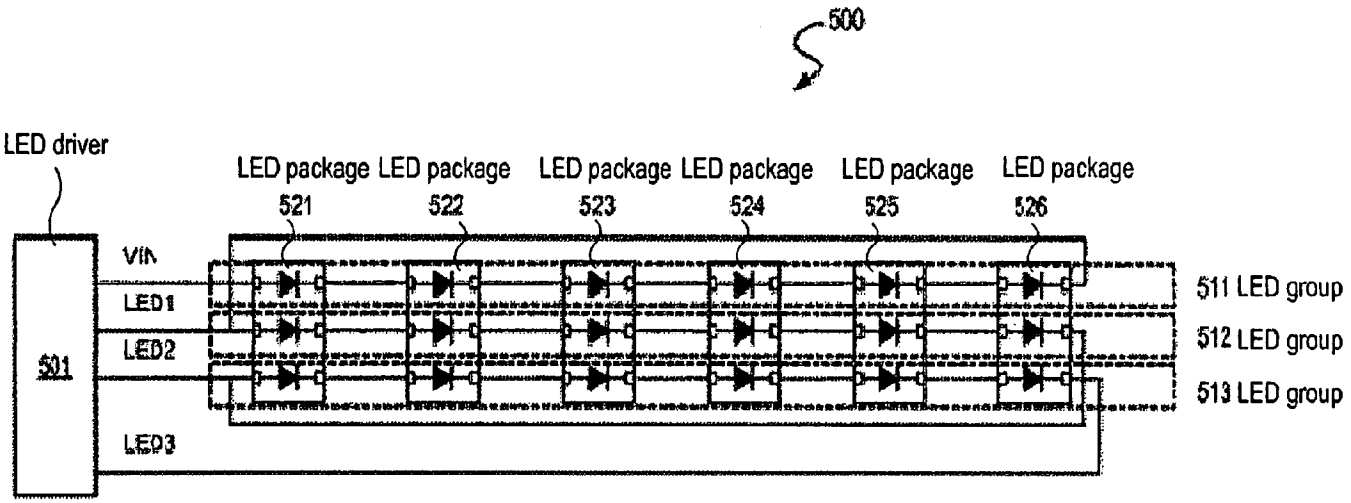
FIG. 5 illustrates an exemplary AC lighting system including distributed LED groups, according to one embodiment.

FIG. 5 illustrates an exemplary AC lighting system including distributed LED groups, according to one embodiment. The direct drive AC lighting system 500 includes an LED driver 501 and an LED load including LED groups 511, 512, and 513. The LED driver 501 controls the LED current that flows through the LED load. According to one embodiment, the LED driver 501 integrates a plurality of high voltage current sinks for each LED groups, LED1, LED2, and LED3.

A commercially available LED package typically includes multiple LED elements. For example, three LED elements are contained in an LED package as shown in FIGS. 1-4. The LED elements in an LED package are typically connected in series to form a serially connected LED segment.

Multiple LED elements are contained in one LED package. Since the same amount of current flows through each LED package, the same amount of light is lit across the AC lighting system as long as the LED packages are distributed uniformly in the AC lighting system 500. Even when each LED group turns on in sequence, uniform light distribution is achieved over the illuminating surface.

According to one embodiment, each one of the three LED elements from each LED package is connected in series to form three uniformly distributed LED groups. Each LED package has one or more LED elements in one or more rows. For example, each of the LED packages 521, 522, 523, 524, 525, and 526 has a single top (or first row), middle (a second row), and bottom (a third row) LED elements. The top LED elements from each of the LED packages 521, 522, 523, 524, 525, and 526 are connected to in series form the LED group 511. Similarly, the middle LED elements and bottom LED elements are connected to form the LED groups 512 and 513, respectively. It is apparent that an LED package contains any number of rows and each row has any number of LED elements without deviating from the scope of the present disclosure. The voltage input VIN from the LED driver 510 is applied to one terminal end of the LED group 511. The other terminal end of the LED group 511 is connected to the current sink LED 1 of the LED driver 501 that controls the current flowing through the LED group 511. The current sink LED1 of the LED driver 501 is also connected to a terminal end of the second LED group 512. Similarly, the current sink LED2 and LED3 control the current flowing through the LED groups 512 and 513, respectively.

The geometric arrangement of LED elements within an LED package may not be critical in achieving the light uniformity. Therefore, this exemplary geometric arrangement of LED elements in a top, middle, and bottom portion of an LED package may not be too much meaningful depending on the number, the arrangement and the orientation of the LED elements within an LED package. The present example shows that each LED package contains three LED elements arranged in a top, middle, and bottom portion. However, it is apparent that one of ordinary skill in the art would recognize that any number and form of LED elements may be contained in a single LED package without deviating from the scope of the present disclosure. The serial connection of the equal number of LED elements (e.g., one LED element) from each LED package would achieve desired uniform light distribution as long as each of the LED elements draws the same current.

Figure 6:
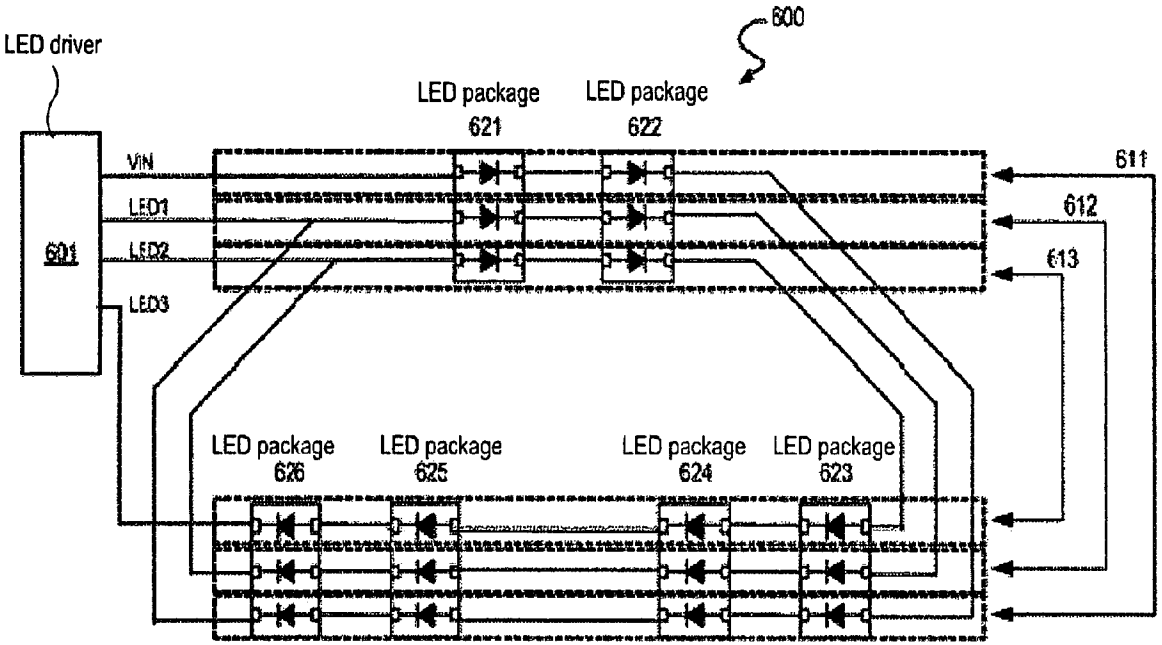
FIG. 6 illustrates an exemplary AC lighting system including distributed LED groups in a bulb type LED light, according to one embodiment.

FIG. 6 illustrates an exemplary AC lighting system including distributed LED groups in a bulb type LED light, according to one embodiment. The direct drive AC lighting system 600 includes an LED driver 601 and an LED load including LED groups 611, 612, and 613. The high voltage current sinks LED1, LED2, and LED3 of the LED driver 601 control the LED current that flows through the respective LED groups 611, 612, and 613.

The direct drive AC lighting system 600 serially connects one LED element from each LED package 621, 622, 623, 624, 625, and 626 to form the LED groups 611, 612, and 613.

The outer LED elements from each LED package are serially connected to form the LED group 611. Similarly, the middle LED elements, and the inner LED elements from each LED package are serially connected to form the LED groups 611 and 612, respectively. Since each LED group encompasses the perimeter of the AC lighting system 600, light emitted from the AC lighting system 600 is uniformly lit. Depending on the current flowing through the LED groups, the light intensity may vary, but the uniformity of emitted light is maintained due to the uniform distribution of the LED elements in each LED group.

Figure 7:
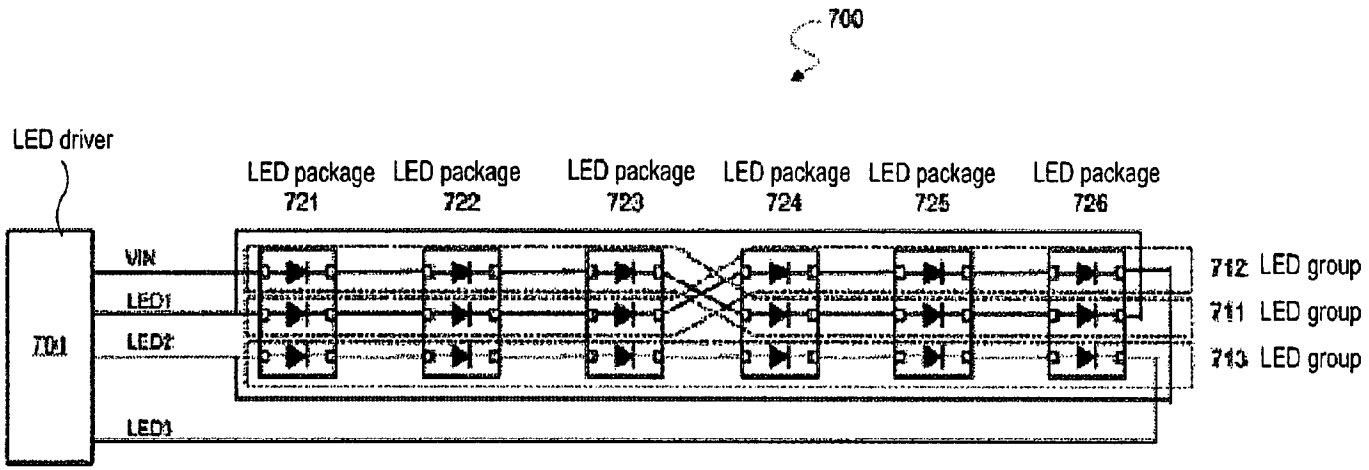
FIG. 7 illustrates another exemplary AC lighting system including distributed LED groups, according to one embodiment.

FIG. 7 illustrates another exemplary AC lighting system including distributed LED groups, according to one embodiment. The direct drive AC lighting system 700 includes an LED driver 701 and an LED load including LED groups 711, 712, and 713. The high voltage current sink LED1, LED2, and LED 3 of the LED driver 701 control the LED current that flows through the LED groups 711, 712, and 713. Similar to the AG lighting system 600, the LED elements from each LED package are serially connected to form an LED group, however, the AC lighting system 700 mixes the LED elements from different portion of the LED packages. For example, the LED group 711 is formed with the top LED elements (first row LED elements) from the LED packages 721, 722, and 723 and middle LED elements (second row LED elements) from the LED packages 724, 725, and 726. Similarly, the LED group 712 is formed with the middle LED elements (second row LED elements) from the LED packages 721, 722, and 723 and the top LED elements (first row LED elements) from the LED packages 724, 725, and 726. The arrangement of LED elements may provide easy PCB routing and proper placements of LED packages on the PCB. However, it is apparent that one of ordinary skill in the art would recognize that a different portion and combination of LED elements may form an LED group, without deviating from the scope of the present disclosure.

Figure 8:
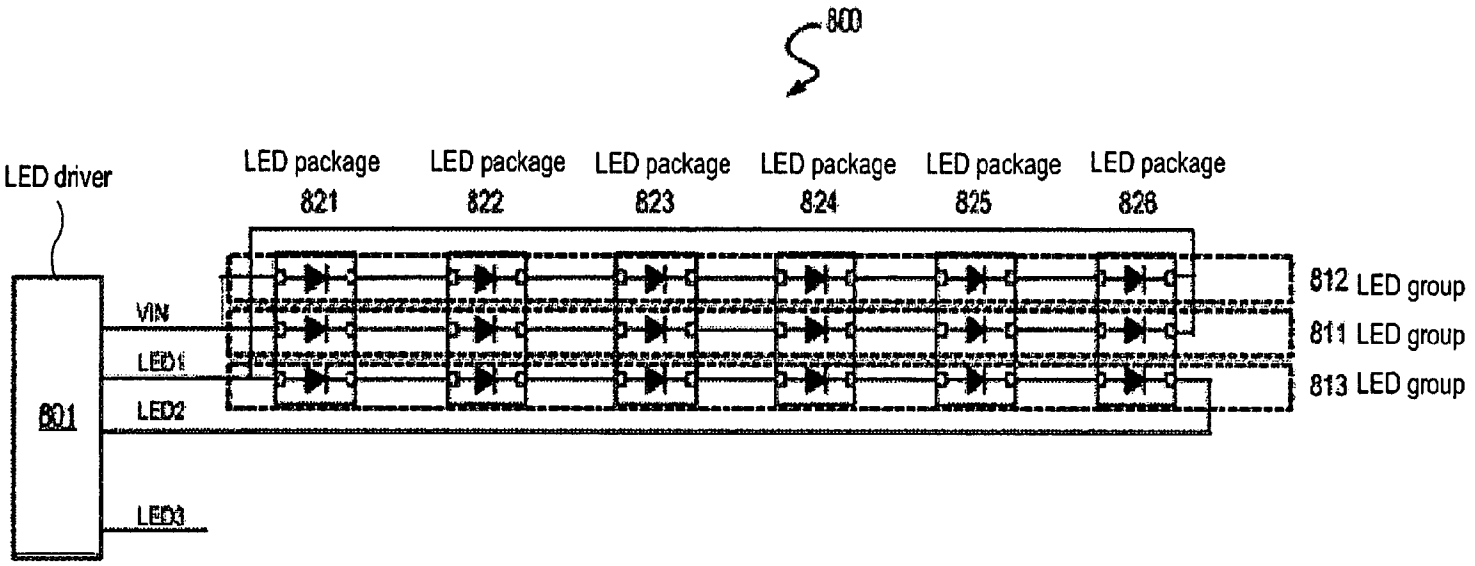
FIG. 8 illustrates yet another exemplary AC lighting system including distributed LED groups, according to one embodiment.

FIG. 8 illustrates yet another exemplary AC lighting system including distributed LED groups, according to one embodiment. The direct drive AC lighting system 800 includes an LED driver 801 and an LED load including LED groups 811, 812, and 813. The high voltage current sink LED1 of the LED driver 801 controls the LED current that flows through the LED groups 811 as well as the LED group 812. The high voltage current sink LED2 of the LED driver 801 controls the LED current that flows through the LED group 813. The high voltage current sink LED3 of the LED driver 801 is unused. It is apparent that one of ordinary skill in the art would recognize that a different grouping of LED elements may form an LED group, without deviating from the scope of the present disclosure. The AC lighting system 800 is useful when low AC voltage supply or high VF LED package is used.

Figure 9:
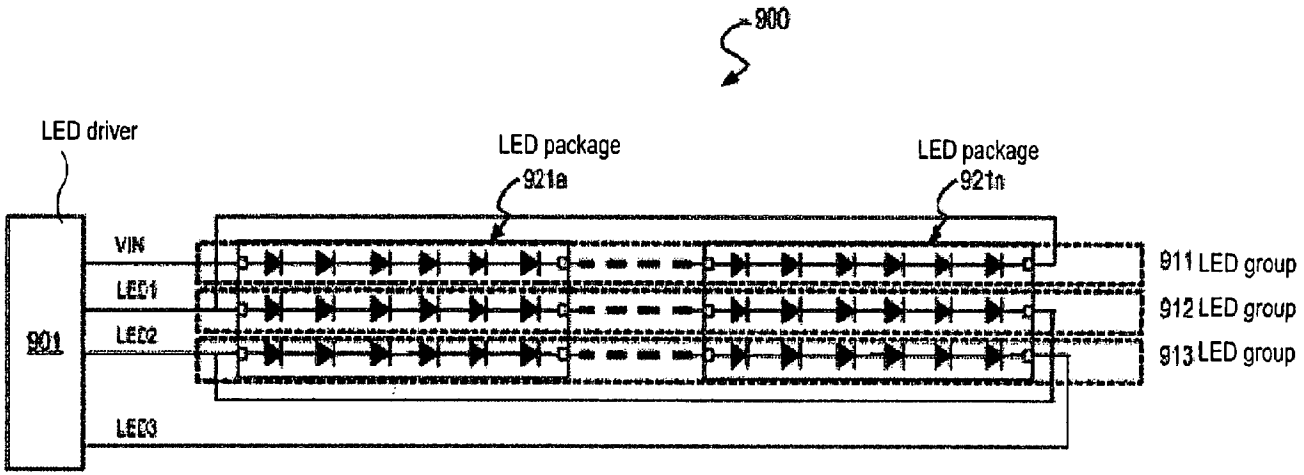
FIG. 9 illustrates an exemplary diagram of an AC direct step driver lighting system including multi-in-one LED packages, according to one embodiment.

FIG. 9 illustrates an exemplary diagram of an AC direct step driver lighting system including multi-in-one LED packages, according to one embodiment. Each of the multi-in-one LED packages 921*a*-921*n* includes multiple LED elements connected in series. Similar to the AC lighting system 500 of FIG. 5, LED segments containing multiple LED elements from each LED package are connected in series. The same number of LED groups and high voltage current sinks are used. In one embodiment, the LED driver 901 has three high voltage current sinks, and the LED elements of the multiple LED packages are grouped together to form three LED groups. In another embodiment, the less number of high voltage current sinks that the number of LED groups are used, such that at least one of the high voltage current sink of the LED driver 900 is unused.

The present disclosure describes various embodiments of an AC direct step lighting system that provides uniform light distribution. The LED packages contained in the AC direct step LED lighting system may be disposed on the illuminating surface of the AC light system with the same or an arbitrary distance between each other to provide uniform light distribution. Each LED groups may be formed by connecting one or more LED terminal(s) in each LED package with the same or an arbitrary distance.

The above exemplary embodiments illustrate various embodiments of implementing an AC lighting system with a direct step LED driver for providing uniform light distribution. Various modifications and departures from the disclosed example embodiments will occur to those having ordinary skill in the art. The subject matter that is intended to be within the scope of the invention is set forth in the following claims.

We claim:

1. An alternating current (AC) lighting system comprising:

a first light emitting diode (LED) group including a first set of LEDs and a second set of LEDs, the first set of LEDs and the second set of LEDs being arranged in series to have a same current flowing through the first and second sets of LEDs;

a second light emitting diode group including a third set of LEDs and a fourth set of LEDs, the third set of LEDs and the fourth set of LEDs being arranged in series to have a same current flowing through the third and fourth sets of LEDs; and the third set of LEDs being interposed between the first set of LEDs and the second set of LEDs, the second set of LEDs being interposed between the third set of LEDs and the fourth set of LEDs.

2. The AC lighting system of claim 1, further comprising:

first and second current sinks coupled to the first and second LED groups respectively, wherein the first current sink controls a first LED current flowing through the first LED group, and wherein the second current sink controls a second LED current flowing through the second LED group.

3. The AC lighting system of claim 2, wherein the first current sink is connected to the first LED group, and wherein the second LED group is serially connected to the first LED group via the first current sink.

4. The AC lighting system of claim 2, further comprising:

a third LED group including fifth and sixth sets of LEDs, the fifth set of LEDs and the sixth set of LEDs being arranged in series to have a same current flowing through the fifth and sixth sets of LEDs wherein the fifth set of LEDs is interposed between the third set of LEDs and the second set of LEDs, the fourth set of LEDs being interposed between the second set of LEDs and the sixth set of LEDs.

5. The AC lighting system of claim 4, further comprising a third current sink, wherein the third current sink controls a third LED current flowing through the third LED group.

6. The AC lighting system of claim 5, wherein the first LED group, the second LED group, and the third LED group are serially connected via the first current sink, the second current sink and the third current sink.

7. The AC lighting system of claim 1, wherein the first set of LEDs of the first LED group includes a first row of LEDs from a first group of LED packages, and a second row of LEDs from a second group of LED packages.

8. An AC lighting system comprising:

a first light emitting diode (LED) group including a first set of LEDs and a second set of LEDs, the first set of LEDs and the second set of LEDs being arranged in series to have a same current flowing through the first and second sets of LEDs;

a second light emitting diode group including a third set of LEDs and a fourth set of LEDs, the third set of LEDs and the fourth set of LEDs being arranged in series to have a same current flowing through the third and fourth sets of LEDs;

a first LED package including the first and third sets of LEDs; and a second LED package including the second and fourth sets of LEDs, an LED in the first LED package being in closer proximity to another LED in the first LED package than an LED in the second LED package.

9. The AC lighting system of claim 8, further comprising first and second current sinks, wherein the first current sink controls a first LED current flowing through the first LED group, and wherein the second current sink controls a second LED current flowing through the second LED group.

10. The AC lighting system of claim 9, wherein the first current sink is connected to the first LED group and, and wherein the second LED group is serially connected to the first LED group via the first current sink.

11. The AC lighting system of claim 8, further comprising a third LED group including fifth and sixth sets of LEDs, the fifth set of LEDs and the sixth set of LEDs being arranged in series to have a same current flowing through the fifth and sixth sets of LEDs, the fifth set of LEDs is included in the first LED package and the sixth set of LEDs is included in the second LED package.

12. The AC lighting system of claim 11, further comprising a third current sink, wherein the third current sink controls a third LED current flowing through the third LED group.

13. The AC lighting system of claim 12, wherein the first LED group, the second LED group, and the third LED group are serially connected via the first current sink, the second current sink and the third current sink.

14. The AC lighting driver system of claim 8, wherein the first set of LEDs of the first LED group includes a first row of LEDs from a first group of LED packages, and a second row of LEDs from a second group of LED packages.

15. A method for driving a plurality of LED groups comprising:

providing an LED driver that is configured to control an LED current flowing through the plurality of LED groups using a plurality of current sinks, the plurality of LED groups including first and second LED groups;

grouping the first LED group into first and second sets of LEDs and arranging the first and second sets of LEDs in series to have a same current flowing through the first and second sets of LEDs; and grouping the second LED group into third and fourth sets of LEDs and arranging the third and fourth sets of LEDs in series to have a same current flowing through the third and fourth sets of LEDs;

interposing the third set of LEDs between the first set of LEDs and the second set of LEDs; and interposing the second set of LEDs between the third set of LEDs and the fourth set of LEDs.

16. The method of claim 15 further comprising:

controlling a first LED current flowing through the first LED group using a first current sink of the plurality of current sinks, and controlling a second LED current flowing through the second LED group using a second current sink of the plurality of current sinks.

17. The method of claim 16, wherein the first current sink is connected to the first LED group, and wherein the second LED group is serially connected to the first LED group via the first current sink.

18. The method of claim 16, wherein the plurality of LED groups includes a third LED group, further comprising:

grouping the third LED group into the fifth and sixth sets of LEDs and arranging the fifth and sixth sets of LEDs in series to have a same current flowing through the fifth and sixth sets of LEDs;

interposing the fifth set of LEDs between the third set of LEDs and the second set of LEDs; and interposing the fourth set of LEDs being interposed between the second set of LEDs and the sixth set of LEDs.

19. The method of claim 18, further comprising:

controlling a third LED current flowing through the third LED group using a third current sink of the plurality of current sinks.

20. The method of claim 19, further comprising:

serially connecting the first LED group, the second LED group, and the third LED group.

21. The method of claim 15, wherein the first set of LEDs of the first LED group includes a first row of LEDs from a first group of LED packages, and a second row of LEDs from a second group of LED packages.

* * * * *